United States Patent [19]

Dingler et al.

[11] Patent Number: 4,586,748

[45] Date of Patent: May 6, 1986

[54] ADJUSTABLE CHAIR IRON

[75] Inventors: Douglas W. Dingler; James F. Gadsbey; Philip E. Crossman, all of Grand Rapids, Mich.

[73] Assignee: Stow & Davis Furniture Company, Grand Rapids, Mich.

[21] Appl. No.: 500,250

[22] Filed: Jun. 1, 1983

[51] Int. Cl.[4] ..... A47C 7/54

[52] U.S. Cl. ..... 297/300; 297/421

[58] Field of Search ..... 248/118; 297/300, 411, 297/421, 306

[56] References Cited

U.S. PATENT DOCUMENTS

| | | | |
|---|---|---|---|
| 1,615,615 | 1/1927 | Cannon et al. | 297/300 |
| 2,056,965 | 10/1936 | Herold . | |
| 2,117,821 | 5/1938 | Parker . | |
| 2,410,871 | 11/1946 | Fields et al. . | |
| 2,602,489 | 7/1952 | Holten . | |
| 2,988,398 | 6/1961 | Hamilton . | |
| 3,578,379 | 5/1971 | Taylor | 297/411 |
| 3,807,799 | 4/1974 | Freedman | 297/417 |
| 3,917,341 | 11/1975 | Albinson | 297/353 |
| 3,966,252 | 6/1976 | Albinson | 297/306 |
| 4,196,480 | 4/1980 | Guenther et al. | 297/411 |
| 4,219,235 | 8/1980 | Heling | 297/417 |
| 4,239,282 | 12/1980 | White | 297/411 |
| 4,277,102 | 7/1981 | Aaras et al. | 297/411 |
| 4,307,913 | 12/1981 | Spiegelhoff | 297/411 |

FOREIGN PATENT DOCUMENTS

| | | | |
|---|---|---|---|
| 2068719 | 8/1981 | United Kingdom | 297/421 |

*Primary Examiner*—William E. Lyddane
*Assistant Examiner*—Joseph Falk
*Attorney, Agent, or Firm*—Price, Heneveld, Huizenga & Cooper

[57] ABSTRACT

The specification discloses a chair including side arms readily and conveniently alignable with one another and/or the chair seat at any time, even after the chair is assembled. More specifically, the control includes a chair iron and a pair of side arms pivotally supported by the iron on opposite sides thereof for movement in a generally vertical plane. Further included is a locking mechanism for releasably locking each arm in one of its pivotal positions to fixedly secure the arms in alignment with respect to the chair iron.

11 Claims, 9 Drawing Figures

ADJUSTABLE CHAIR IRON

BACKGROUND OF THE INVENTION

The present invention relates to chair controls, and more particularly to a chair control supporting a pair of side arms on opposite sides of the control.

The present invention relates to a structural improvement for the type of chair having a back mounted on arms which are shiftably supported on a control for tilting both the arms and back. Generally, this type of chair comprises a chair control supported on a base, a chair seat and a pair of side arms supported on the control, and a chair back supported by and between the chair arms. The side arms are shiftably supported on the control to permit the chair back to be reclined. More particularly, the chair arms are fixedly secured to a common shiftable axle on the control. When the chair arms are properly aligned with one another and the seat cushion (FIG. 1), the chair has an aesthetically pleasing symmetrical appearance. However, accurately and properly aligning the side arms mounted on the common axle is extremely difficult. Even a relatively small twist, for example two degrees, throughout the length of the arm-supporting axle results in highly skewed chair arms as illustrated in FIG. 2. The skewed chair arms present a most undesirable and unacceptable appearance, also causing the chair back to be skewed. Further, because of the strong materials utilized to fabricate the axle to provide its desired strength, subsequent realignment of the chair arms from the position illustrated in FIG. 2 is extremely difficult, if not impossible.

In this type of chair, the assembly of the arms and back on the control has been difficult, time consuming, and expensive. Examples of chairs wherein side arms are fixedly supported on the chair control include U.S. Pat. No. 3,966,252, entitled CHAIR STRUCTURE AND TILT MECHANISM THEREFOR, issued June 29, 1976, to Albinson; and U.S. Pat. No. 3,917,341, entitled CHAIR BACK HEIGHT ADJUSTMENT MECHANISM, issued Nov. 4, 1975, to Albinson.

SUMMARY OF THE INVENTION

The aforementioned problems are solved by the present invention wherein a chair control is provided enabling the chair side arms to be easily and conveniently aligned with each other and the chair seat during, and even subsequent to, manufacture. More particularly, the chair control includes an axle assembly for pivotally supporting the chair arms on the chair control for adjustable movement in a generally vertical plane. Further included is a locking mechanism for releasably locking the chair arms in any one of their pivotal positions to secure the chair arms in alignment.

The present invention greatly alleviates chair arm alignment problems. The chair can be assembled without particular immediate concern for the alignment of the chair arms, either with one another or the chair seat. After the chair has been initially assembled, the chair arm locking mechanism is released, and both arms are pivoted about the axle assembly so that the arms can be aligned both with one another and the chair seat. When the arms have been properly aligned, the locking mechanism is locked, securing the arms in their aligned state. Consequently, the chair control of the present invention greatly facilitates the speed at which chairs can be assembled, improves the appearance of the finished chairs, and insures that all chairs have acceptably aligned arms. Further, the chair facilitates realignment of the chair arms subsequent to manufacture in cases where the chair arms are bumped or forced out of alignment, for example during shipping or accidents.

These and other objects, advantages, and features of the invention will be more readily understood and appreciated by reference to the detailed description of the preferred embodiment and drawings.

DETAILED DESCRIPTION OF THE PREFERRED EMBODIMENT

Figure 1:
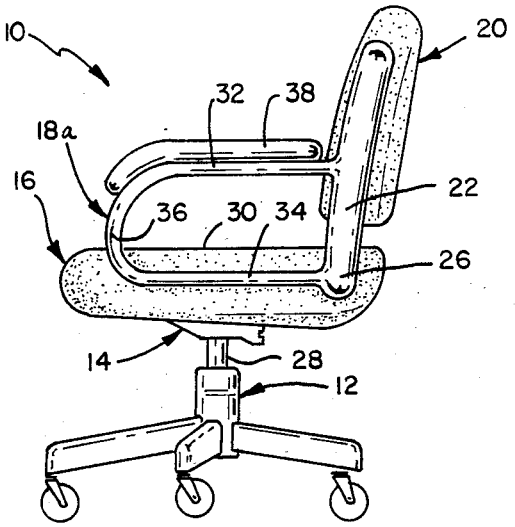
FIG. 1 is a side elevational view of the chair of the present invention with the side arms properly aligned.
Figure 2:
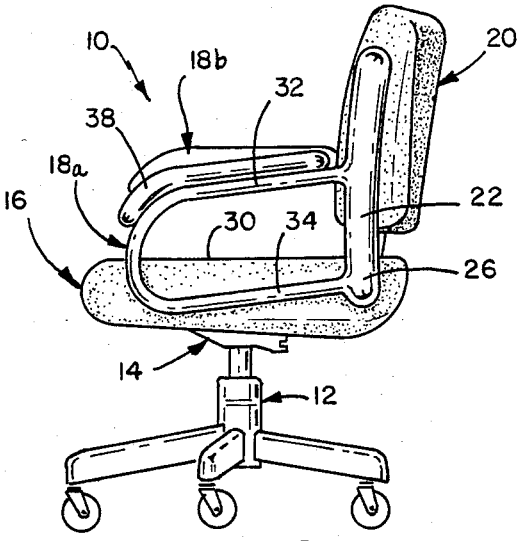
FIG. 2 is a side elevational view of the chair with the side arms improperly aligned.

A chair constructed in accordance with a preferred embodiment of the invention is illustrated in FIGS. 1 and 2 and generally designated 10. The chair generally comprises base 12, control 14 mounted on the base, chair seat 16 supported on the control, a pair of side arms 18*a* and 18*b* supported by the control on opposite sides of the chair seat, and chair back 20 supported between the side arms. Side arms 18 each include a generally vertical chair back support member 22 aligned with chair back 20 and having lower end 26. Each side arm 18 is supported on arm support assembly 24 (see FIGS. 3–6) for pivotal movement about lower end 26. Therefore, chair back 20 may be reclined rearwardly by exerting a rearward force against the back, whereupon side arms 18 pivot rearwardly about lower ends 26. Arm support assemblies 24 permit the ready angular alignment of arms 18, for example from the position in FIG. 2 to the desired position in FIG. 1, to allow the chair arms to be easily and accurately aligned after the chair has been assembled.

Base 12, chair seat 16, and chair back 20 are generally well known to those having ordinary skill in the art (FIG. 1). More particularly, base 12 is a five-arm base including vertical post 28, upon which control 14 is supported. Seat 16 and back 20 are upholstered assemblies incorporating the required structure to provide proper support for a chair occupant. Seat 16 includes upper surface 30 which defines a generally horizontal line when viewed in side elevation as in FIGS. 1 and 2. Chair back 20 is supported by and between side arms 18 as is generally well known in the art, for example using a stud-and-aperture or tongue-and-groove construction.

Side arms 18 (FIGS. 1–2) each include a generally vertically oriented back support member 22 from which extend forwardly horizontal upper and lower arm members 32 and 34, respectively. The chair arm members are interconnected at their forward edges by a gently curving integral bight portion 36 to complete the aesthetically pleasing proportions of arm 18. Armrest 38 is secured on top of upper member 32 and extends partway around bight portion 36 to provide a comfortable support for the chair occupant's forearms.

Each of arms 18 further includes a wedge-lock assembly 40 (FIGS. 5, 6, and 8) for securing the chair arm within the associated arm support assembly 24. The wedge-lock assembly comprises stud 42 including integral stationary wedge half 44, sliding wedge half 46, threaded post 48, and hex nut 50. Stud 42 including wedge half 44 is integrally formed with arm 18 to extend generally perpendicularly from lower end 26 of support member 22 to provide a pivot point for the arm. Stud 42 is generally square in cross section (see FIG. 8) and is mounted on arm 18 such that its diagonals are oriented vertically and horizontally. Wedge half 44 is generally triangular in cross section throughout its length and includes engagement surfaces 52*a* and 52*b* (see FIG. 8) generally perpendicular to member 22 and wedge surface 54 which meet end 56 (see FIG. 6). Wedge surface 54 is oriented at approximately a 30 degree angle to member 22 to provide a wedge slide surface for wedge 46. Threaded post 48 is fixedly secured within stud 42 and more particularly within aperture 58 to provide a mechanical advantage in tightening wedge assembly 40. Wedge 46 is also generally triangular in cross section throughout its length including engagement surfaces 60*a* and 60*b* and wedge surface 62 which meet end 64. Wedge surface 62 is inclined at approximately a 30 degree angle from engagement surfaces 60 to provide a wedge slide surface between wedge halves 44 and 46. Elongated bore 66 (FIGS. 6 and 8) is defined by wedge half 46 to receive threaded shaft 48 as the wedge half slides against stationary wedge half 44. Hex nut 50 and washer 68 are secured on threaded post 48 to shift wedge halves 46 and 44 relative one another. Arm 18 is secured in square tube 104 by first loosening wedge assembly 40, inserting the wedge assembly into the tube, and then tightening the wedge assembly to force engagement surfaces 52 and 60 radially into engagement with the tube.

Figure 7:
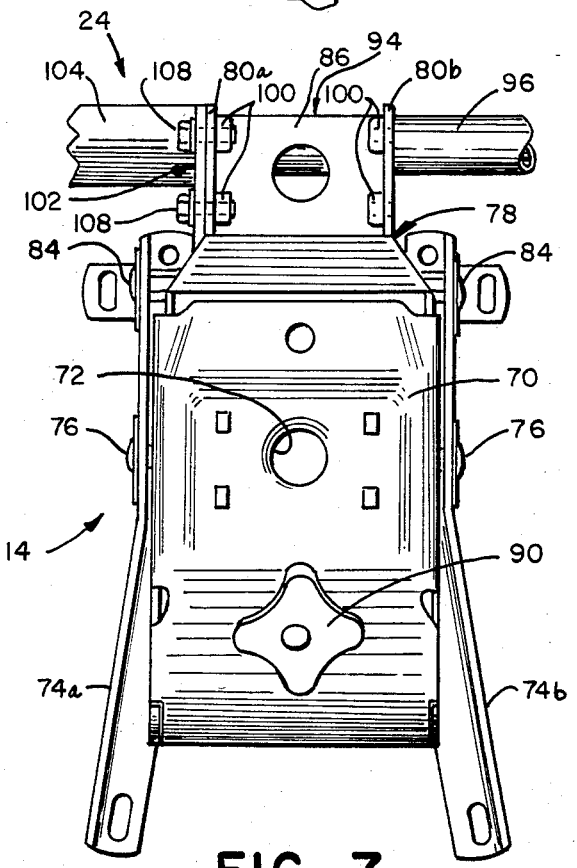
FIG. 7 is a fragmentary bottom plan view of the chair control.

Chair control 14 (FIGS. 3, 4, and 7) is generally well known to those having ordinary skill in the art with the exception of arm support assembly 24. More specifically, chair control 14 includes pan 70 defining socket 72 which receives pedestal post 28 to support the chair control on pedestal 12. Seat support members 74 are pivotally supported on pan 70 at pivots 76. Back support assembly 78 is pivotally secured to pan 70 on pivots 82 and to seat members 74 on pivots 84. Spring 88 (FIG. 4) is secured to pan 70 and bears against back support assembly 78 to bias the back support assembly and therefore seat members 74 into their fully forward or task position illustrated in the drawings. Control knob 90 is operatively supported in pan 70 and connected to spring 38 to provide a means of regulating the tension on the spring. Chair control 10 provides synchrotilt movement, meaning that the back reclines at a faster rate than the seat because of the particular pivotal interconnection of the back support assembly 78 at two points 82 and 84. Chair control 10 as thus far described has long been manufactured and sold by Faultless-Doerner Manufacturing Inc. of Waterloo, Ontario, Canada.

Arm support assembly 24 (FIG. 5) generally comprises axle assembly 92 and two arm pivot assemblies 94*a* and 94*b* mounted thereon. Axle assembly 92 is fixedly supported on chair back support assembly 78 for reclining movement therewith and includes a pair of spaced parallel plates 80*a* and 80*b* secured to the back support assembly interconnected by plate 86. Cylindrical tubular axle 96 is supported by plates 80 and fixedly secured therein, for example by welding. Each of plates 80 includes a pair of apertures 98 each having welded nut 100 (see FIG. 7) aligned therewith.

Figure 9:
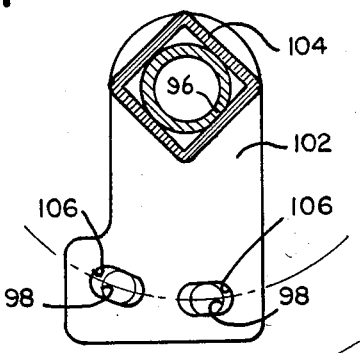
FIG. 9 is a sectional view of the assembled arm support assembly taken along plane IX—IX in FIG. 5.
Figure 5:
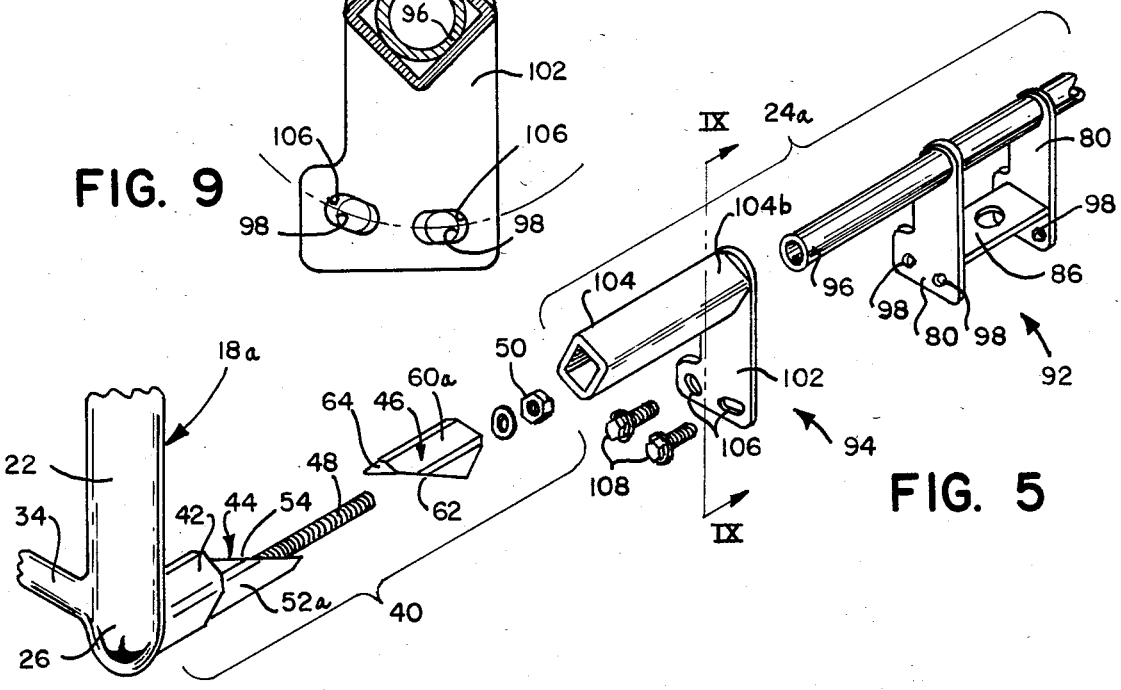
FIG. 5 is a fragmentary perspective exploded view of one side arm and arm support assembly.
Figure 6:
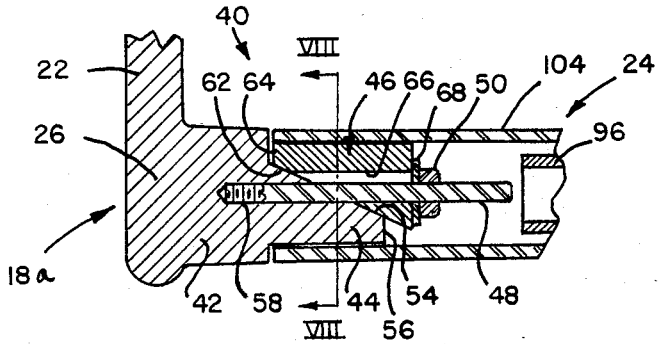
FIG. 6 is a fragmentary sectional view of the assembled side arm and arm support assembly.
Figure 8:
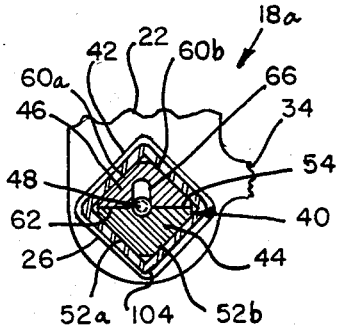
FIG. 8 is a fragmentary sectional view taken along plane VIII—VIII in FIG. 6.
Figure 3:
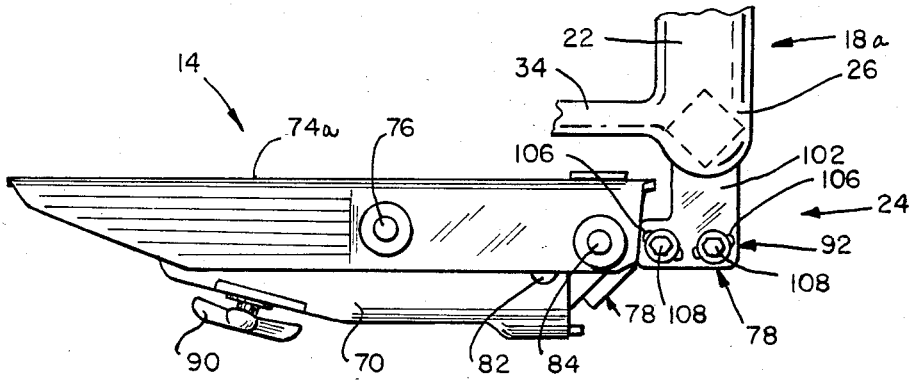
FIG. 3 is a fragmentary side elevational view of the chair control and one side arm mounted thereon.

Arm pivot assembly 94 (FIG. 5) includes generally planar slide plate 102 preferably having generally the same shape and dimensions as side plate 80*a*. Extending generally perpendicularly from and fixedly secured to slide plate 102 is slide tube 104, which is generally square in cross section. The interior width of slide tube 104 is generally the same as or slightly larger than the outer diameter of axle 96 so that the slide tube can be slid onto the axle and pivot thereon. Slide plate 102 defines a pair of elongated apertures 106 which are oriented generally tangentially to the center of slide tube 104 (FIG. 9). A pair of hex-head bolts 108 extend through elongated apertures 106 and are secured in nuts 100 on side plate 80 to releasably secure or lock plates 80 and 102 together. As illustrated in FIGS. 6 and 8, wedge-lock assembly 40 is secured within tube 104 to support arm 18 on assembly 24.

ASSEMBLY AND OPERATION

Base 12, control 14, seat 16, arms 18, and back 20 are all fabricated individually prior to final chair assembly. Only the securement and alignment of arms 18 to control 14 will be described herein as the assembly of the remainder of the chair is routine to those having ordinary skill in the art.

Figure 4:
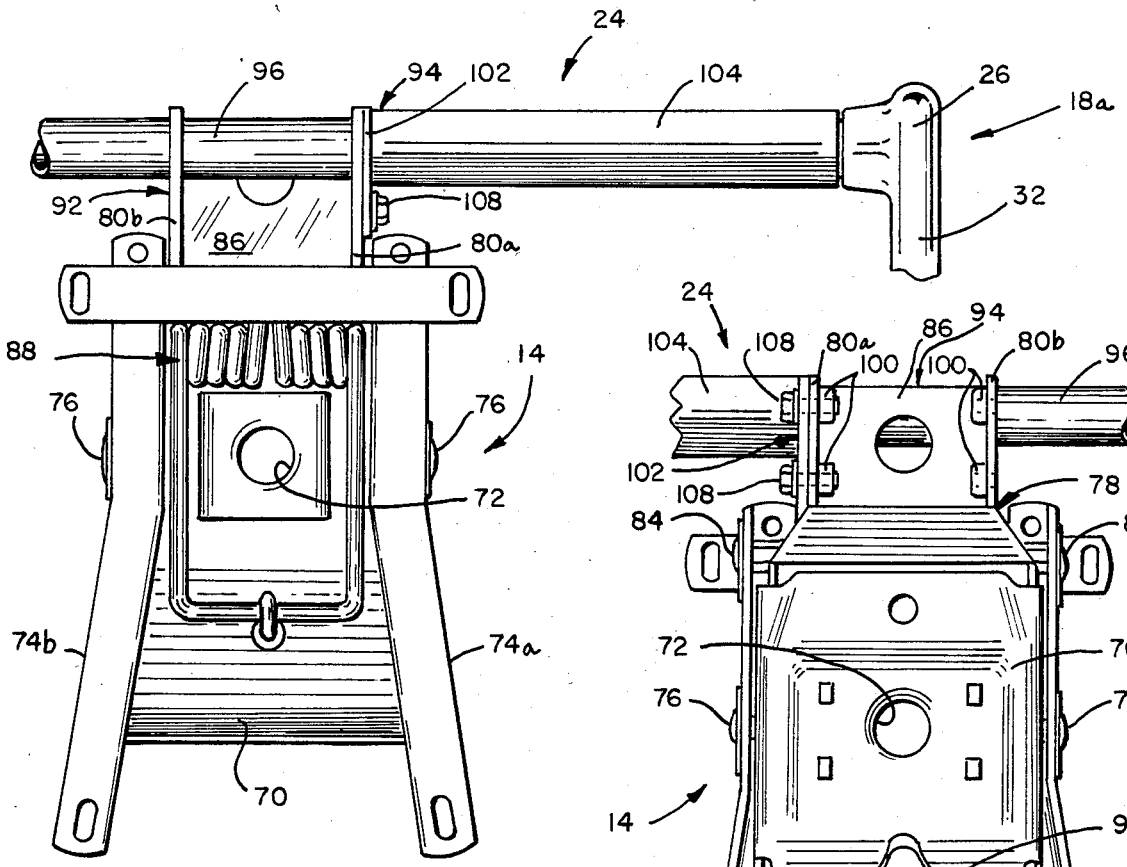
FIG. 4 is a fragmentary top plan view of the chair control and one side arm.

Each arm 18 is secured within arm pivot assembly 94 and more particularly within tube 104 prior to installation of the pivot assembly on axle 96. Wedge half 46 is slid onto threaded member 48 such that wedge surfaces 54 and 62 slidingly engage one another. Washer 68 and nut 50 are initially threaded onto member 48 to complete the initial assembly of wedge-lock assembly 40. The assembled wedge-lock assembly is slid into tube 104 until stud 42 abuts the tube as illustrated in FIGS. 4 and 6. A wrench (not shown) can then be inserted through plate end 104*b* of slide tube 104 and onto nut 50 to drive the nut and force wedge halves 44 and 46 radially outwardly into engagement with slide tube 104 to secure arm 18 within the slide tube. Arm pivot assembly 94 with arm 18 secured therein is then slid over axle 96 until slide plate 102 abuts and overlies side plate 80 of axle assembly 92. Slide tube 104 is free to pivot about axle 96 with plate 80 and 102 slidingly abutting each other during such pivotal movement. Hex-head bolts 108 are inserted through elongated slots 106 and secured in nuts 100 to releasably lock plates 80 and 102 together. Because slots 106 are oriented generally tangentially to the center of slide tube 104, the elongated slots remain aligned with holes 98 throughout the pivotal movement of slide tube 104 on axle 96.

After both seat 16 and arm 18 have been mounted on control 10, the arms are aligned with one another and also preferably with upper surface 30 of the chair seat. This alignment is easily and conveniently accomplished preferably before bolts 108 are tightened by pivoting arms 18 on support assembly 24 until the arms are aligned as illustrated in FIG. 1. In such alignment, the bolts slide in the elongated apertures 106. Bolts 108 are then tightly secured within nuts 100 to lock or secure plates 80 and 102 together preventing subsequent angular movement of arms 18. At any subsequent time that arms 18 become misaligned, the arms may be readily realigned by loosening bolts 108, adjusting the arms as necessary, and resecuring the bolts.

The above description is that of a preferred embodiment of the invention. Various changes and alterations may be made without departing from the spirit and broader aspects of the invention as defined in the appended claims, which are to be interpreted in accordance with the principles of patent law, including the doctrine of equivalents.

The embodiments of the invention in which an exclusive property or privilege is claimed are defined as follows:

1. A chair control comprising:

means for supporting a chair seat; and arm support means for supporting left and right chair arms on opposite sides of the chair seat, said arm support means including pivotal mounting means for pivotally mounting at least one of the chair arms with respect to said chair seat support means for movement in a generally vertical plane, said pivotal mounting means including an axle member and an arm support member to support the one chair arm, said arm support member being pivotally supported by said axle member, said arm support means further including releasable locking means for releasably locking said pivotal mounting means in a desired pivotal position, said releasable locking means including a first plate fixedly supported with respect to said axle member and a second plate fixedly supported with respect to said arm support member, said plates being in generally overlying sliding relation to each other, said releasable locking means further including means for releasably securing said overlying plates together, whereby the one chair arm can be readily aligned with respect to said chair seat support means.

2. A chair control comprising:

means for supporting a chair seat; and arm support means for supporting left and right chair arms on opposite sides of the chair seat, said arm support means including pivotal mounting means for pivotally mounting at least one of the chair arms with respect to said chair seat support means for movement in a generally vertical plane, said pivotal mounting means including an axle member and an arm support member to support the one chair arm, said arm support member being pivotally supported by said axle member, said arm support member including a slide tube slidingly received over said axle member, said arm support means further including releasable locking means for releasably locking said pivotal mounting means in a desired pivotal position, said releasable locking means including a first plate supported in fixed relation to said axle member, a second plate supported in fixed relation to said slide tube, said plates being in generally overlying sliding relation to each other, and means for releasably securing said overlying plates together, whereby the one chair arm can be readily aligned with respect to said chair seat support means.

3. A chair comprising:

a chair iron;

left and right chair arms; and left and right arm support means for supporting said left and right chair arms, respectively, on said chair iron, each of said arm support means including angular adjusting means for angularly adjusting the associated chair arm with respect to said chair iron in a generally vertical plane, each of said angular adjusting means including pivotal support means for pivotally supporting the associated chair arm on said chair iron for movement in said generally vertical plane, each of said pivotal support means including an axle member supported by said chair iron, and a tubular member fixedly secured to the associated chair arm, said tubular member being pivotally carried on said axle member, each of said arm support means further comprising means for releasably fixedly securing the associated chair arm with respect to said chair iron, said releasable securing means including a first plate fixedly supported on said axle member, and a second plate fixedly supported on said tubular member, said plates abutting and overlying one another, said releasable securing means further including means for releasably locking said plates together whereby said chair arms can be readily and easily aligned with respect to said chair iron.

4. A chair comprising:

a chair iron;

left and right chair arms; and left and right arm support means for supporting said left and right chair arms, respectively, on said chair iron, each of said arm support means including angular adjusting means for angularly adjusting the associated chair arm with respect to said chair iron in a generally vertical plane, each of said angular adjusting means including pivotal support means for pivotally supporting the associated chair arm on said chair iron for movement in said generally vertical plane, each of said pivotal support means including an axle member supported by said chair iron and a tubular member fixedly secured to the associated chair arm, said tubular member being pivotally carried on said axle member, each of said chair arms including wedge-lock means extending from said each arm into the associated tubular member for wedgedly securing said each arm therein, each of said arm support means further including means for releasably fixedly securing the associated chair arm with respect to said chair iron, whereby said chair arms can be readily and easily aligned with respect to said chair iron.

5. A chair as defined in clai 4 wherien said releasable securing means comprises:

a first plate supported in fixed relation to said axle member;

a second plate supported in fixed relation to said tubular member, said plates abutting and overlying one another; and means for releasably locking said plates together.

6. A chair comprising:

a chair iron;

left and right chair arms; and left and right arm support means for supporting said left and right chair arms, respectively, on said chair iron, each of said arm support means including angular adjusting means for angularly adjusting the associated chair arm with respect to said chair iron in a generally vertical plane, each of said angular adjusting means including pivotal support means for pivotally supporting the associated chair arm on said chair iron for movement in said generally vertical plane, each of said pivotal support means including a tubular member, each of said chair arms including wedge-lock means extending into the associated tubular member for wedgingly securing said each chair arm therein, each of said arm support means further including means for releasably fixedly securing the associated chair arm with respect to said chair iron, whereby said chair arms can be readily and easily aligned with respect to said chair iron.

7. A chair comprising:

a chair iron;

left and right chair arms; and left and right arm support means for supporting said left and right chair arms, respectively, on said chair iron, each of said arm support means including angular adjusting means for angularly adjusting the associated chair arm with respect to said chair iron in a generally vertical plane, each of said arm support means including a tubular member, each of said chair arms including wedge-lock means extending into the associated tubular member for wedgingly securing said each arm therein, each of said arm support means further including means for releasably fixedly securing the associated chair arm with respect to said chair iron, whereby said chair arms can be readily and easily aligned with respect to said chair iron.

8. A chair control comprising:

axle means for supporting left and right back support members on opposite sides of said chair control, said axle means being shiftable with respect to said chair control;

pivotal mounting means for pivotally mounting at least one of the back support members for movement with respect to said axle means in a generally vertical plane; and releasable locking means for releasably locking said pivotal mounting means in a desired pivotal position, whereby the one back support member can be readily aligned with respect to said chair control.

9. A chair comprising:

a chair iron including an elongated member extending laterally from said iron;

a chair arm;

a tubular member supporting said chair arm on said elongated member, said tubular member including a first end for receiving said chair arm and an opposite second end telescopically received on said elongated member; and securing means operatively coupled to said chair arm and extending into said first tubular member end for securing said arm within said tubular member, said securing means including actuating means located within said tubular member and accessible through said tubular member from said second end, said locking means including wedge-lock means actuable through said tubular member from said second tubular member end, whereby said arm can be secured to said tubular member before said tubular member is mounted on said elongated member.

10. A chair as defined in claim 9 further comprising means for securing said tubular member to said chair iron.

11. A chair as defined in claim 1 further comprising means for securing said tubular member to said chair iron.

* * * * *